US011027289B2

(12) United States Patent
Allan et al.

(10) Patent No.: US 11,027,289 B2
(45) Date of Patent: Jun. 8, 2021

(54) WET ELECTROSTATIC PRECIPITATOR SYSTEM COMPONENTS

(71) Applicants: Robert A. Allan, Kitchener (CA); Paul McGrath, Mississauga (CA)

(72) Inventors: Robert A. Allan, Kitchener (CA); Paul McGrath, Mississauga (CA)

(73) Assignee: Durr Systems Inc., Southfield, MI (US)

( * ) Notice: Subject to any disclaimer, the term of this patent is extended or adjusted under 35 U.S.C. 154(b) by 0 days.

(21) Appl. No.: 14/324,567

(22) Filed: Jul. 7, 2014

(65) Prior Publication Data

US 2016/0001300 A1 Jan. 7, 2016
US 2017/0113230 A9 Apr. 27, 2017

Related U.S. Application Data

(63) Continuation of application No. 13/259,900, filed on Dec. 9, 2011, now abandoned.

(51) Int. Cl.

| | |
|---|---|
| ***B03C 3/53*** | (2006.01) |
| ***B03C 3/64*** | (2006.01) |
| ***B03C 3/16*** | (2006.01) |
| ***B03C 3/49*** | (2006.01) |
| ***B03C 3/45*** | (2006.01) |

(52) U.S. Cl.
CPC ..... *B03C 3/53* (2013.01); *B03C 3/16* (2013.01); *B03C 3/45* (2013.01); *B03C 3/49* (2013.01); *B03C 3/64* (2013.01)

(58) Field of Classification Search
CPC combination set(s) only.
See application file for complete search history.

(56) References Cited

U.S. PATENT DOCUMENTS

| | | | |
|---|---|---|---|
| 687,109 | A | 11/1901 | Baum |
| 710,655 | A | 10/1902 | Angell |
| 1,322,163 | A | 11/1919 | Conover |
| 1,399,422 | A | 12/1921 | Chubb |
| 1,602,597 | A | 10/1926 | Staude |
| 1,773,073 | A | 8/1930 | Beach |
| 1,773,973 | A | 8/1930 | Edgar |
| 1,793,664 | A | 2/1931 | Anderson |
| 1,813,637 | A | 7/1931 | Powers |
| 2,357,355 | A | 9/1944 | Penney |

(Continued)

FOREIGN PATENT DOCUMENTS

| | | | |
|---|---|---|---|
| CA | 643389 | A | 6/1962 |
| CA | 2505248 | A1 | 5/2004 |

(Continued)

OTHER PUBLICATIONS

Supplementary European Search Report for European Patent Application No. 12763929.2, dated Nov. 20, 2014.

(Continued)

*Primary Examiner* — Christopher P Jones
*Assistant Examiner* — Sonji Turner

(57) ABSTRACT

The present invention relates to the use of corrosion, temperature and spark resistant electrically conductive components in wet electrostatic precipitator systems (WESPs). In particular, the present invention is directed to using a conductive composite material in the fabrication of wet electrostatic precipitator system components.

5 Claims, 2 Drawing Sheets

(56) References Cited

U.S. PATENT DOCUMENTS 2,567,709 A 9/1951 Hedberg
2,696,892 A 12/1954 Campbell
2,712,362 A 7/1955 Winklepeck
2,720,551 A 10/1955 Wästvind et al.
2,794,847 A 6/1957 Streuber et al.
2,806,896 A 9/1957 Streuber et al.
2,830,869 A 4/1958 Limerick
2,935,375 A 5/1960 Boucher
3,046,716 A 7/1962 Rodger
3,104,963 A 9/1963 Bonnett
3,297,903 A 1/1967 Riek
3,403,497 A 10/1968 Vander Mey
3,495,123 A 2/1970 Raddatz
3,512,340 A 5/1970 Golücke
3,584,440 A 6/1971 Vigil
3,595,983 A 7/1971 Muller et al.
3,605,386 A 9/1971 Erwin et al.
3,716,966 A 2/1973 De Seversky
3,721,069 A 3/1973 Walker
3,745,751 A 7/1973 Zey et al.
3,765,154 A 10/1973 Hardt et al.
3,793,802 A 2/1974 Hardt
3,798,883 A 3/1974 Heeney
3,883,328 A * 5/1975 Spain ..... B03C 3/60 422/121
3,918,939 A * 11/1975 Hardt ..... B03C 3/64 96/99
4,070,424 A 1/1978 Olson et al.
4,117,255 A 9/1978 Kawaike et al.
4,141,698 A 2/1979 Kihlstedt et al.
4,155,792 A * 5/1979 Gelhaar ..... B03C 3/64 156/172
4,177,047 A 12/1979 Goland
4,247,307 A 1/1981 Chang
4,251,682 A 2/1981 Ebert et al.
4,290,738 A 9/1981 Liebert et al.
4,294,591 A 10/1981 Kahl
4,318,719 A 3/1982 Kato et al.
4,360,367 A 11/1982 Prior
4,375,364 A 3/1983 Van Hoesen et al.
4,431,617 A 2/1984 Farin
4,439,216 A 3/1984 Perryman
4,505,776 A 3/1985 Murray
4,507,341 A 3/1985 Heseltine
4,522,634 A 6/1985 Frank
4,601,731 A 7/1986 Michelson
4,704,363 A 11/1987 Ziegler
4,846,857 A 7/1989 Tachibana
4,885,139 A 12/1989 Sparks et al.
4,893,752 A 1/1990 Spink et al.
4,908,047 A 3/1990 Leonard
4,948,399 A 8/1990 Reuffurth et al.
4,957,512 A 9/1990 Denisov et al.
5,192,517 A 3/1993 Spink
5,248,324 A 9/1993 Hara
5,254,155 A 10/1993 Mensi
5,295,310 A 3/1994 Eriksson
5,308,589 A 5/1994 Yung
5,344,481 A 9/1994 Pettersson
5,363,567 A 11/1994 Best
5,364,457 A 11/1994 Cameron
5,395,430 A 3/1995 Lundgren et al.
5,401,302 A 3/1995 Schulmerich et al.
5,482,540 A 1/1996 Trinward et al.
5,498,462 A 3/1996 Darfler
5,599,508 A 2/1997 Martinelli et al.
5,603,751 A 2/1997 Ackerson
5,603,752 A 2/1997 Hara
5,702,993 A * 12/1997 Kubomura ..... B29C 70/22 139/426 R
5,714,226 A 2/1998 Disselbeck
5,843,210 A 12/1998 Paranjpe et al.
5,855,652 A 1/1999 Talley
5,917,138 A 6/1999 Taylor
5,922,290 A 7/1999 Jenne et al.
6,004,375 A 12/1999 Gutsch et al.
6,156,098 A 2/2000 Richards
6,106,592 A * 8/2000 Paranjpe ..... B03C 3/16 95/65
6,176,902 B1 1/2001 Matsubara
6,231,643 B1 * 5/2001 Pasic ..... B03C 3/47 95/75
6,267,802 B1 7/2001 Baldrey et al.
6,508,861 B1 1/2003 Ray
6,579,349 B1 6/2003 Ting et al.
6,579,506 B2 6/2003 Spink et al.
6,599,349 B1 7/2003 Scharkowski
6,620,224 B1 9/2003 Sato
6,673,953 B2 * 1/2004 Keller ..... B82Y 30/00 252/502
6,890,504 B2 * 5/2005 Keller ..... B82Y 30/00 423/440
6,974,494 B1 12/2005 Zahedi
7,160,348 B2 1/2007 Allan
7,160,358 B2 1/2007 Spink et al.
7,198,771 B2 * 4/2007 Keller ..... B82Y 30/00 423/440
7,938,146 B2 5/2011 Brooks et al.
8,597,416 B2 * 12/2013 Allan ..... B03C 3/16 55/DIG. 38
2003/0082315 A1 5/2003 Mehlman et al.
2003/0114698 A1 * 6/2003 Keller ..... B82Y 30/00 556/136
2004/0044236 A1 * 3/2004 Keller ..... B82Y 30/00 556/46
2004/0044237 A1 * 3/2004 Keller ..... B82Y 30/00 556/46
2004/0139853 A1 7/2004 Bologa et al.
2004/0169162 A1 10/2004 Yue et al.
2004/0221720 A1 11/2004 Gordon et al.
2004/0226449 A1 11/2004 Heckel et al.
2005/0028674 A1 2/2005 Robert
2005/0045038 A1 3/2005 Huang
2005/0123717 A1 6/2005 Shen et al.
2005/0229780 A1 10/2005 Spink et al.
2007/0051237 A1 3/2007 Furukawa et al.
2007/0201183 A1 * 8/2007 Komatsu ..... H01G 4/2325 361/311
2007/0283903 A1 12/2007 Bologa et al.
2009/0014378 A1 1/2009 Hundley et al.
2009/0142980 A1 6/2009 Chen
2009/0241781 A1 * 10/2009 Triscori ..... B01D 53/32 96/4
2010/0236413 A1 * 9/2010 Allan ..... B03C 3/16 96/28
2012/0073442 A1 * 3/2012 Allan ..... B03C 3/16 96/52

FOREIGN PATENT DOCUMENTS

CA WO 2012129656 A1 * 10/2012 ..... B03C 3/16
CN 2376335 Y 5/2000
DE 30 27 307 A1 5/1981
DE 102004001463 A1 8/2005
GB 553420 A 5/1943
GB 556 939 A 10/1943
GB 1413127 11/1975
JP 52-1574 A 1/1977
JP 57194001 11/1982
JP 60 149449 A 8/1985
JP 1-258754 A 10/1989
JP 06190300 A 7/1994
JP 10202142 A 4/1998
JP 11151410 6/1999
WO 1990005027 A1 5/1990
WO 1992019380 A1 11/1992
WO 1996001678 A1 1/1996
WO 2005007295 A1 1/2005
WO 2005097297 A1 10/2005
WO 2006113749 * 10/2006 ..... B03C 3/41
WO 2008/154735 A1 12/2008
WO 2008154735 * 12/2008 ..... B03C 3/41
WO 2008154735 A1 12/2008

(56) References Cited

FOREIGN PATENT DOCUMENTS

| | | | |
|---|---|---|---|
| WO | 2010/108256 | A1 | 9/2010 |
| WO | 2010108256 | A1 | 9/2010 |
| WO | 2011/120137 | A1 | 10/2011 |

OTHER PUBLICATIONS

Third Chinese Office Action, dated Jan. 14, 2015, CN Application No. 201080022796.0.
Second Chinese Office Action, dated Jul. 30, 2014, CN Application No. 201080022796.0.
First Chinese Office Action, dated Aug. 13, 2013, CN Application No. 201080022796.0.
Response to Second Chinese Office Action, dated Oct. 13, 2014, CN Application No. 201080022796.0.
Response to First Chinese Office Action, dated Feb. 28, 2014, CN Application No. 201080022796.0.
Response to Second Chinese Office Action, CH Application No. 201180026189.6.
International Search Report, dated Jun. 26, 2012 , International Application No. PCT/CA2012/000277.
Rushton J.D., Sirrine J.E., Collection and Treatment of Odorous Kraft Mill Gases. Paper Trade Journal/ 1972, pp. 36-37. (Dec. 18, 1972).
Fourth Chinese Office Action, dated Jul. 30, 2013, CH Application No. 200880013191.8.
Response to Third Chinese Office Action, CH Application No. 200880013191.8.
Third Chinese Office Action, dated Apr. 1, 2013, CH Application No. 200880013191.8.
Response to Second Chinese Office Action, CH Application No. 200880013191.8.
Second Chinese Office Action, dated Nov. 27, 2013, CH Application No. 200880013191.8.
Response to First Chinese Office Action, CH Application No. 200880013191.8.
First Chinese Office Action, dated Apr. 16, 2012, CH Application No. 200880013191.8.
Perry et al. Chemical Engineers' Handbook (5th Ed.) McGraw-Hill Book Co. USA;15BN 0-67-049478-9; p. 22-24, 1973.
Notice of Allowance, dated Dec. 31, 2014, U.S. Appl. No. 13/699,752.
Notice of Allowance, dated Jan. 21, 2015, U.S. Appl. No. 13/394,828.
Canadian Office Action, dated Mar. 23, 2009, Canadian Patent Application No. 2532640.
Canadian Office Action, dated Aug. 5, 2008, Canadian Patent Application No. 2532640.
International Preliminary Report on Patentability, dated Jan. 23, 2006, International Application No. PCT/CA2004/001037.
Written Opinion, dated Aug. 12, 2005, International Application No. PCT/CA2005/000549.
International Preliminary Report on Patentability, dated Aug. 12, 2005, International Application No. PCT/CA2005/000549.
Communication pursuant to Article 94(3) EPC, dated Jul. 18, 2012, EP Application No. 04737969.8.
Communication pursuant to Article 94(3) EPC, dated Sep. 23, 2009, EP Application No. 04737969.8.
Written Opinion, dated May 1, 2006, International Application No. PCT/CA2006/000238.
International Preliminary Report on Patentability, dated Oct. 11, 2006, International Application No. PCT/CA2006/000238.
Written Opinion, dated Aug. 28, 2006, International Application No. PCT/CA2006/000755.
International Preliminary Report on Patentability, dated Nov. 13, 2007, International Application No. PCT/CA2006/000755.
Communication pursuant to Article 94(3) EPC, dated Apr. 23, 2014, EP Application No. 05735662.8.
Communication pursuant to Article 94(3) EPC, dated Sep. 15, 2011, EP Application No. 05735662.8.
EPC Examination, dated Mar. 10, 2009, EP Application No. 05735662.8.
Supplementary European Search Report, dated Jul. 12, 2007, EP Application No. 05735662.8.
Canadian Office Action, dated Sep. 9, 2010, Canadian Application No. 2562372.
Canadian Office Action, dated Jul. 30, 2012, Canadian Application No. 2598187.
Canadian Office Action, dated Jun. 14, 2013, Canadian Application No. 2598187.
Canadian Office Action, dated Feb. 6, 2014, Canadian Application No. 2598187.
Response to Communication, dated Aug. 26, 2014, EP Application No. 06705193.8.
Communication pursuant to Article 94(3) EPC, dated Apr. 17, 2014, EP Application No. 06705193.8.
Canadian Office Action, dated Feb. 24, 2012, Canadian Application No. 2607978.
Communication pursuant to Article 94(3) EPC, dated Dec. 4, 2012, EP Application No. 08741470.6.
Written Opinion, dated Jul. 21 2008, International Application No. PCT/CA2008/000752.
International Preliminary Report on Patentability, dated Jul. 21 2008, International Application No. PCT/CA2008/000752.
Written Opinion, dated Sep. 19, 2008, International Application No. PCT/CA2008/001157.
International Preliminary Report on Patentability, dated Sep. 19, 2008, International Application No. PCT/CA2008/001157.
Canadian Office Action, dated Mar. 12, 2014, Canadian Application No. 2684781.
Canadian Office Action, dated Oct. 2, 2014, Canadian Application No. 2684781.
EPC Examination, dated May 14, 2013, EP Application No. 08748166.9.
Written Opinion, dated May 31, 2010, International Application No. PCT/CA2010/000377.
International Preliminary Report on Patentability, dated May 31, 2010, International Application No. PCT/CA2010/000377.
Written Opinion, dated Dec. 22, 2010, International Application No. PCT/CA2010/001404.
International Preliminary Report on Patentability, dated Dec. 22, 2010, International Application No. PCT/CA2010/001404.
Written Opinion, dated Aug. 17, 2011, International Application No. PCT/CA2011/000599.
International Preliminary Report on Patentability, dated Aug. 17, 2011, International Application No. PCT/CA2011/000599.
Canadian Office Action, dated Aug. 6, 2012, Canadian Application No. 2750691.
Canadian Office Action, dated May 8, 2013, Canadian Application No. 2750691.
Canadian Office Action, dated Nov. 20, 2013, Canadian Application No. 2750691.
Supplementary European Search Report, dated Sep. 26, 2013, EP Application No. 10755346.3.
First Chinese Office Action, dated Aug. 13, 2013, CH Application No. 201080022796.0.
Second Chinese Office Action, dated Jul. 30, 2014, CH Application No. 201080022796.0.
Canadian Office Action, dated Nov. 4, 2014, Canadian Application No. 2773620.
Supplementary European Search Report, dated Dec. 11, 2103, EP Application No. 10 81 4843.
Written Opinion, dated Jun. 26, 2012, International Application No. PCT/CA2012/000277.
International Preliminary Report on Patentability, dated Jun. 26, 2012, International Application No. PCT/CA2012/000277.
Supplementary European Search Report, dated Nov. 3, 2014, International Application No. PCT/CA2012/000277.
Supplementary European Search Report, dated Dec. 20, 2103, EP Application No. 10 81 4843.8.
First Chinese Office Action, dated Sep. 23, 2013, CH Application No. 201180026189.6.

(56) References Cited

OTHER PUBLICATIONS

Second Chinese Office Action, dated May 7, 2014, CH Application No. 201180026189.6.
Response to First Chinese Office Action, CH Application No. 201180026189.6.
Written Opinion, dated Jan. 23, 2006, International Application No. PCT/CA2004/001037.

* cited by examiner

WET ELECTROSTATIC PRECIPITATOR SYSTEM COMPONENTS

FIELD OF INVENTION

The present invention relates to the use of corrosion, temperature and spark resistant electrically conductive components in wet electrostatic precipitator systems (WESPs). In particular, the present invention is directed to the use of a novel conductive composite material for making wet electrostatic precipitator system components.

BACKGROUND TO THE INVENTION

Wet electrostatic precipitators have been used for many years to remove dust, acid mist and other particulates from water-saturated air and other gases by electrostatic means. In a WESP, particulates and/or mist laden water-saturated air flows in a region of the precipitator between discharge and collecting electrodes, where the particulates and/or mist is electrically charged by corona emitted from the high voltage discharge electrodes. As the water-saturated gas flows further within the WESP, the charged particulate matter and/or mist is electrostatically attracted to grounded collecting plates or electrodes where it is collected. The accumulated materials are continuously washed off by both an irrigating film of water and periodic flushing.

This type of system is used to remove pollutants from the gas streams exhausting from various industrial sources, such as incinerators, wood products manufacturing, coke ovens, glass furnaces, non-ferrous metallurgical plants, coal-fired generation plants, forest product facilities, food drying plants and petrochemical plants.

Traditionally, the collecting surfaces and other parts of electrostatic precipitators exposed to the process gas stream have been fabricated from carbon steel, stainless steel, corrosion and temperature resistant alloys, lead and fiberglass reinforced plastics. However, such materials tend to corrode and/or degrade over time especially when the precipitators are used in severe environments. Carbon and stainless steel tend to corrode or erode under severe acid conditions. Reinforced plastics tend to erode and/or delaminate due to severe corrosive conditions and localized high temperature in regions of sparking.

There is, therefore, a need to manufacture components exposed to a gas stream within a wet electrostatic precipitator that are not only corrosion resistant under severe industrial environments, but also electrically conductive and resistant to localized high temperatures due to sparking and arcing.

SUMMARY OF INVENTION

The present invention is concerned with providing corrosion resistant and temperature and heat dissipating components used in wet electrostatic precipitator systems. More particularly, the present invention provides an electrically conductive, corrosion and spark resistant composite material for fabricating such components as found in wet electrostatic precipitator systems.

In accordance with an aspect of the present invention, there is provided a novel electrically conductive, corrosion resistant and temperature resistant composite material with good heat dissipation for use in the fabrication of components used in wet electrostatic precipitator systems in which the components are in direct contact with the process gas stream.

In accordance with a further aspect of the present invention, there is provided a novel collecting surface for use in wet electrostatic precipitator systems, the collecting surface being fabricated from an electrically conductive corrosion and temperature resistant composite material having good heat dissipation properties so as not to degrade under typical sparking/arcing conditions.

In accordance with yet a further aspect of the present invention, there is provided a collection tube for use in wet electrostatic precipitator systems, the collection tube being fabricated from an electrically conductive, corrosion and temperature resistant spark/arc tolerant composite material. Preferably, the collection tubes are formed in bundles within the system.

In accordance with yet another aspect of the present invention, there is provided a wet electrostatic precipitator system, the system comprising at least one component fabricated from an electrically conductive, corrosion and temperature resistant spark/arc tolerant composite material.

BRIEF DESCRIPTION OF THE DRAWINGS

A detailed description of the preferred embodiments are provided herein below with reference to the following drawings in which.

Figure 1:
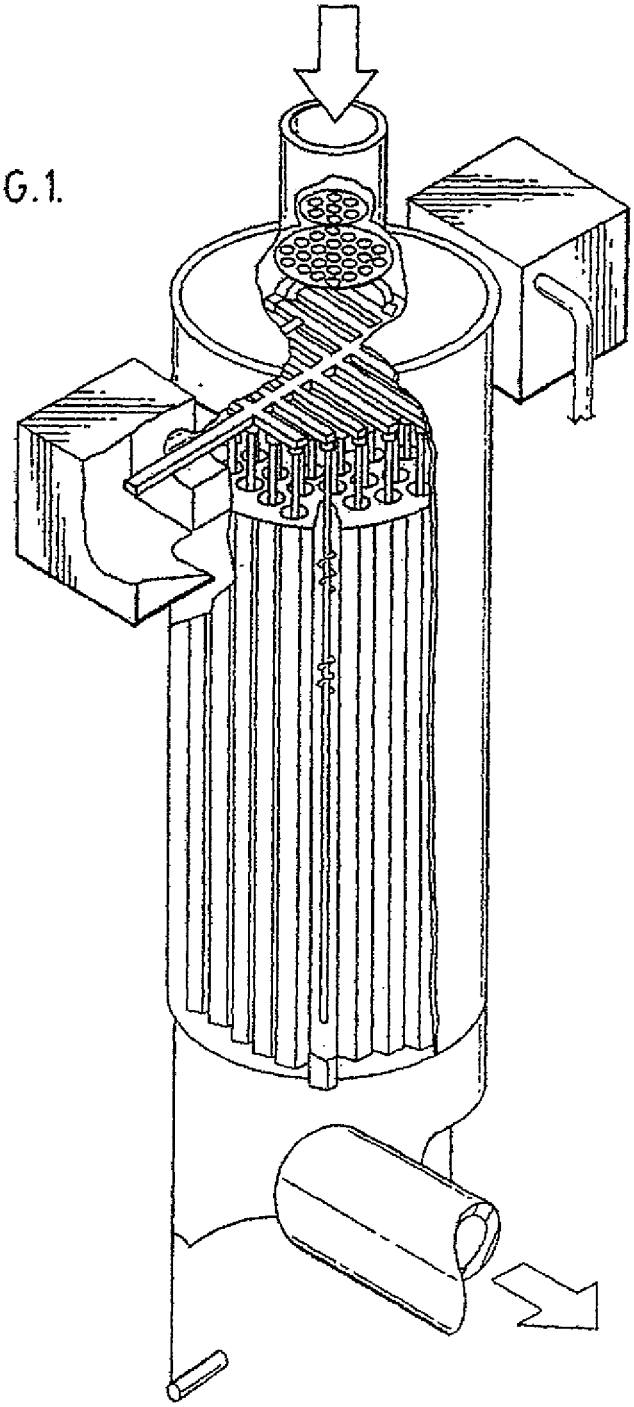
FIGS. 1 and 2 are perspective views of a SonicKleen™ wet electrostatic precipitation system.

In the drawings, preferred embodiments of the invention are illustrated by way of example. It is to be expressly understood that the description and drawings are only for the purpose of illustration and as an aid to understanding, and are not intended as a definition of the limits of the invention. In particular, the electrostatic precipitator may have any desired orientation, configuration or type, including upflow, horizontal flow, downflow, tube type or plate type.

GENERAL DESCRIPTION OF INVENTION

The conductive composite material utilized herein is a conductive composite material designed for highly corrosive operating conditions including dry and saturated mist environments with elevated temperatures. The composite material is a blend of carbon fiberglass and thermosetting resins developed for applications subjected to corona voltage flash over, spark, erosion, corrosion and power arc, including wet electrostatic precipitation.

In particular, the composite material comprises carbon fiberglass and within a thermosetting resin where extremely strong molecular building blocks form totally cross-linked structures bonded to each other and as interconnects. The resultant network has proven to withstand high voltage current after the onset of corona in the tubes of the electrostatic precipitator, obtaining voltage flash over without pitting the conductive hybrid composite material. Such spark resistance and arc-over may be generated at a voltage of approximately 60 to 95 KV at up to 500 to 1000 milliamps for a duration of approximately 1 millisecond. The composite material is also resistant to sustained arcing with a duration of up to 4 to 5 seconds. These properties are highly desirable to minimize corrosion and restrict high intensity heat generation and to prevent structural, mechanical or chemical changes to the conductive hybrid composite material.

The carbon fibers woven into a seamless biaxial material sleeve creates a dense network imparting electrical conductivity and thermal dispersion within thermosetting resins.

Strong molecular building blocks form totally cross-linked structures bonded to each other and as interconnects, producing a three-dimensional network, stitched through the thickness of the laminate. The carbon fibers are woven into seamless biaxial and triaxial material. This arrangement imparts excellent electrical conductivity and superior thermal dispersion through the laminate.

In addition to the electro-conductive characteristics and excellent corrosion resistant properties, the conductive hybrid composite material also provides further advantages as a material of construction, reducing the dead load weight by one half or more, due to the lightweight and high strength qualities of carbon fiberglass which results in economic benefits before installation especially beneficial for tube bundles made from stainless steel and even higher grades of titanium.

The composite may be prepared by weaving, stitching, alignment through vibration using frequency while the material may be formed into shapes that are tubes and sheets by prior art processes known as vacuum infusion, pultrusion, filament winding and autoclaving.

The conductive composite material overcomes the problems of corrosion affecting stainless steel, alloys, titanium within a highly corrosive environment, saturated mists and elevated temperatures, by improving on prior art thermosetting resins and carbon fiberglass compositions that cannot withstand the corona voltage flash over and power arcs at up to 100,000 Volts.

A conductive hybrid composite material suitable for use in this application is described in U.S. Provisional Patent Application No. 60/886,718, filed Jan. 26, 2007 and U.S. patent application Ser. No. 12/136,362 filed Jun. 10, 2008 (now abandoned) in the name of Crawford Dewar, the disclosures of which are incorporated herein by reference.

Figure 2:
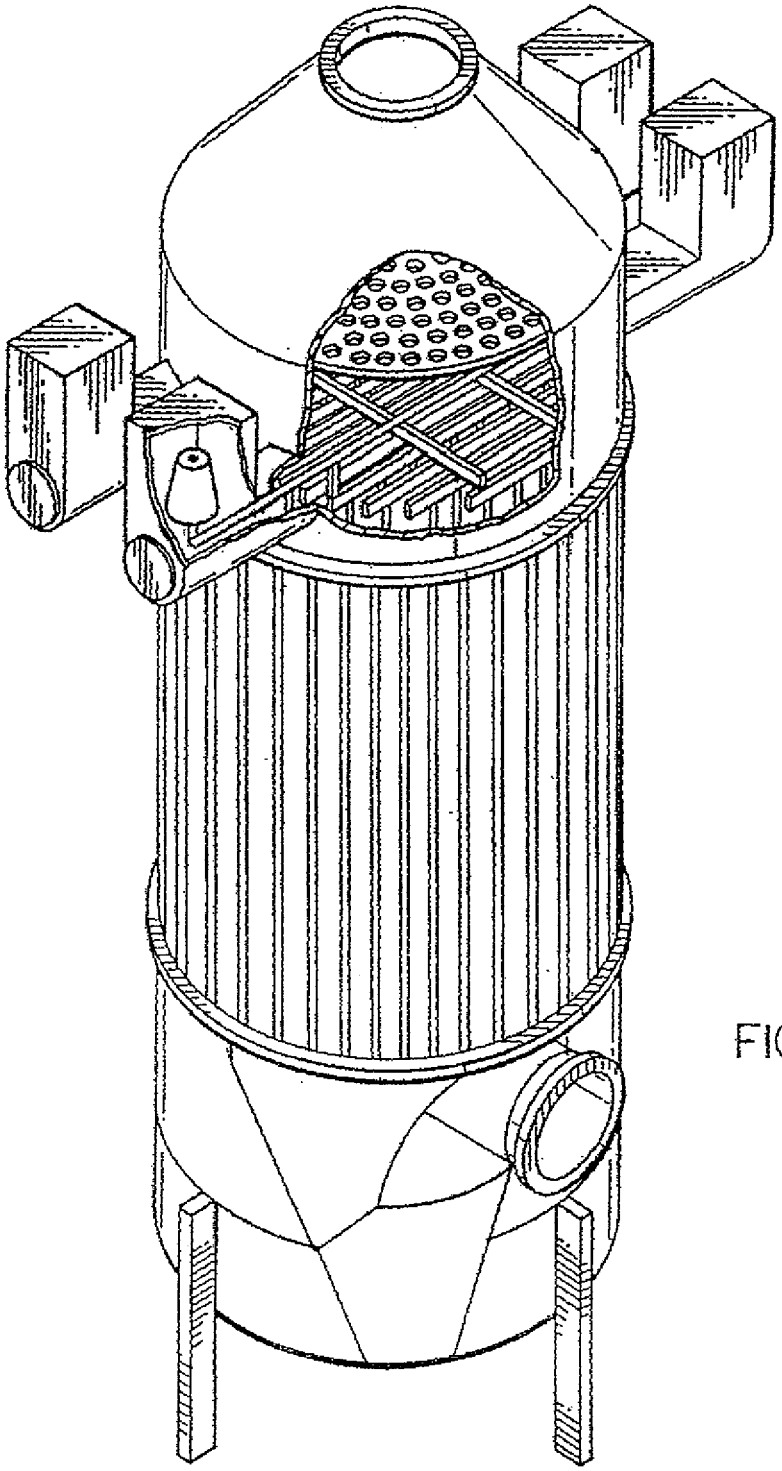

In one embodiment, the composite material of the present invention is particularly useful for the fabrication of collecting electrode tubes as used in wet electrostatic precipitators, which may be cylindrical or hexagonal or plate type. One such type of wet electrostatic precipitator is referred to as the SonicKleen™ WESP, which is shown in FIGS. 1 and 2. This precipitator has incorporated therein a rigid mast electrode technology, which concentrates the ionizing corona in specific zones within the electrode tube instead of distributing it along the entire length. It has been realized and demonstrated that fabrication of the collection electrode tubes used in such precipitator with the composite material described herein increases the durability of the tubes as they are less prone to corrosion and spark/arc damage than conventionally used materials, such as stainless steels, lead and carbon. It has also been shown that the composite material can withstand greater and more severe environmental conditions as typically encountered in industrial gas cleaning applications than conventional materials presently used.

The composite material described herein can be used to fabricate components used in wet electrostatic precipitator systems as used in various applications such as but not limited to chemical incinerators, textile processing, pulp and paper, coke ovens, hog fuel boilers, blue haze abatement, veneer and particle board or other biomass dryers, glass furnaces, stannic chloride collection, sulfur oxide control, fly ash control, pharmaceutical processes, detergent dryers, cogeneration, distilling liquors and beers, phosphorus furnace emissions, silicon manufacturing, power plant emissions, ammonia removal, phosphate fertilizer manufacturing, phosphoric acid manufacturing, liquid waste incinerators, solid waste incinerators, corn dryings, sulfuric acid plants, incineration of sewage sludge, rotary kiln cleaning, cement plants, scrap wood, acid mists, vapor condensed organics, metal finishing, paint finishing, chemical point emissions and petrochemical plants.

It is understood by one skilled in the art that the composite material of the present invention can be used to fabricate any component of a wet electrostatic precipitator and is particularly useful for those components directly in contact with the process gas stream. The composite material of the present invention can withstand the corona voltage flash over and power arcs at up to 100,000 volts at high temperatures (of 93.3° C. (200° F.)) over prolonged periods of time, and up to 648.9° C. (1200° F.) in localized areas for short periods of time. The material is electrically conductive, corrosion and temperature resistant even under the severe environments encountered in industrial gas cleaning applications.

SUMMARY OF DISCLOSURE

In summary of this disclosure, the present invention provides a novel hybrid conductive composite material for use in making components of wet electrostatic precipitators directly exposed to process gas streams. Modifications can be made within the scope of the invention.

The invention claimed is:

1. A collecting electrode tube for use in a wet electrostatic precipitator, the collecting electrode tube fabricated from an electrically conductive, corrosion and spark resistant, and temperature-resistant composite material consisting essentially of carbon fiberglass within a thermosetting resin in a cross-linked structure or carbon fibers woven into a seamless biaxial material tube within a thermosetting resin.

2. The collecting electrode tube of claim 1 wherein the collecting electrode tube is in direct contact with a process gas stream passing through the wet electrostatic precipitator.

3. The collecting electrode tube of claim 1 wherein the collecting electrode tube is one of cylindrical, hexagonal and plate type.

4. The collecting electrode tube of claim 1 wherein the composite material withstands corona voltage flash over and power arcs up to 100,000 V.

5. A wet electrostatic precipitator comprising a component intended to be in direct contact with a process gas stream passing through the wet electrostatic precipitator, said component being a collecting electrode tube, or a bundle of collection collecting electrode tubes, each collecting electrode tube fabricated from an electrically conductive, corrosion and spark resistant, and temperature-resistant composite material consisting essentially of carbon fiberglass within a thermosetting resin in a cross-linked structure or carbon fibers woven into a seamless biaxial material tube within a thermosetting resin.

* * * * *